US008235118B2

(12) United States Patent
Schultz et al.

(10) Patent No.: US 8,235,118 B2
(45) Date of Patent: Aug. 7, 2012

(54) GENERATING HEATED FLUID

(75) Inventors: Roger L. Schultz, Aubrey, TX (US); Travis W. Cavender, Angleton, TX (US); Matt E. Blauch, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 514 days.

(21) Appl. No.: 11/774,318

(22) Filed: Jul. 6, 2007

(65) Prior Publication Data

US 2009/0008090 A1 Jan. 8, 2009

(51) Int. Cl.
*E21B 36/00* (2006.01)
*E21B 43/24* (2006.01)

(52) U.S. Cl. ..... 166/303; 166/305.1; 166/59

(58) Field of Classification Search ..... None
See application file for complete search history.

(56) References Cited

U.S. PATENT DOCUMENTS 2,680,487 A * 6/1954 Carpenter ..... 175/14
2,871,941 A * 2/1959 Allen et al. ..... 166/261
3,235,006 A * 2/1966 Hujsak ..... 166/302
3,746,088 A * 7/1973 Haskin et al. ..... 166/59
3,777,816 A * 12/1973 Meier ..... 166/260
4,453,597 A * 6/1984 Brown et al. ..... 166/303
4,475,596 A * 10/1984 Papst ..... 166/303
4,867,238 A * 9/1989 Bayless et al. ..... 166/261

FOREIGN PATENT DOCUMENTS

WO WO2006/063200 * 6/2006

OTHER PUBLICATIONS

"Hydrocarbon" Schlumberger Oilfield Glossary, retrieved from http://www.glossary.oilfield.slb.com/Display.cfm?Term=hydrocarbon.*

* cited by examiner

*Primary Examiner* — Angela M DiTrani
(74) *Attorney, Agent, or Firm* — Fish & Richardson P.C.

(57) ABSTRACT

A subterranean zone is treated by exothermically decomposing hydrogen peroxide in or near the subterranean zone. The decomposed hydrogen peroxide yields at least oxygen and heated water. The oxygen is combusted to further heat the heated water. The heated water is introduced into subterranean zone to treat the subterranean zone. In certain instances, the heated water is heated to produce 100% quality steam. Additional water may be supplied for treating the subterranean zone, for example, by supplying the hydrogen peroxide in solution with water.

23 Claims, 2 Drawing Sheets

GENERATING HEATED FLUID

TECHNICAL FIELD

This disclosure relates to treating subterranean zones using heated fluid.

BACKGROUND

Heated fluid, such as steam, can be injected into a subterranean formation to facilitate production of fluids from the formation. For example, steam may be used to reduce the viscosity of fluid resources in the formation, so that the resources can more freely flow into the well bore and to the surface. Generally, steam generated for injection into a well requires large amounts of energy such as to compress and/or transport air, fuel, and water used to produce the steam. Much of this energy is largely lost to the environment without being harnessed in any useful way. Consequently, production of steam has large costs associated with its production.

SUMMARY

The present disclosure relates to treating a subterranean zone using heated fluid introduced into the subterranean zone via a well bore. For example, the heated fluid may be provided (e.g., injected) into a subterranean zone to reduce the viscosity of in-situ resources and increase flow of the resources through the subterranean zone to one or more well bores. The heated fluid may be used in huff and puff, steam assisted gravity drainage (SAGD), or other operations. The fluid is heated, in some instances, to form steam. However, the heated fluid may take the form of liquid, vapor and/or gas, and may include water, carbon monoxide and/or other fluids. The subterranean zone can include all or a portion of a resource bearing subterranean formation, multiple resource bearing subterranean formations, or all or part of one or more other intervals that it is desired to treat with the heated fluid. The fluid is heated, at least in part, using heat from decomposing a reactant, for example hydrogen peroxide.

One aspect encompasses a method for treating a subterranean zone. In the method hydrogen peroxide is exothermically decomposed in or near the subterranean zone to yield at least oxygen and heated water. The oxygen from decomposition is combusted to further heat the heated water, and the subterranean zone is treated with the heated water.

Another aspect encompasses a system for treating a subterranean zone. The system includes a downhole reactor having a catalyst for decomposing hydrogen peroxide into at least water and oxygen. It also has a downhole combustor in communication with the downhole reactor and configured to receive the water and oxygen, combust the oxygen to heat the water and output the heated water to the subterranean zone.

Yet another aspect encompasses a method whereby hydrogen peroxide and fuel are supplied into a well bore. The hydrogen peroxide is contacted with a catalyst to decompose it into at least water and oxygen. The oxygen and the fuel are then combusted to heat the water.

Various of the aspects encompass one or more of the following features. The hydrogen peroxide can be in a solution comprising water, and combusting the oxygen to further heat the water includes combusting the oxygen to further heat both the water from decomposing hydrogen peroxide and the water from solution. Combusting the oxygen can include providing a fuel in or near the subterranean zone and combusting the oxygen and fuel. The oxygen can be combusted in a downhole catalytic combustor. Exothermically decomposing the hydrogen peroxide includes exothermically decomposing the hydrogen peroxide in a downhole reactor comprising a catalyst. The heated water can be separated from the oxygen in a downhole separator. The solution can include at least 27% hydrogen peroxide by mass, for example to make saturated steam at 1500 psi. The fuel gas can include methane gas. The heated water can be heated to 100% quality steam. The hydrogen peroxide can be pumped into the subterranean zone.

The details of one or more embodiments are set forth in the accompanying drawings and the description below. Other features, objects, and advantages will be apparent from the description and drawings, and from the claims.

DETAILED DESCRIPTION

The present disclosure relates to treating a subterranean zone using heated fluid introduced into the subterranean zone via a well bore. For example, the heated fluid may be provided (e.g., injected) into a subterranean zone to reduce the viscosity of in-situ resources and increase flow of the resources through the subterranean zone to one or more well bores. The heated fluid may be used in huff and puff, steam assisted gravity drainage (SAGD), or other operations. The fluid is heated, in some instances, to form steam. However, the heated fluid may take the form of liquid, vapor and/or gas, and may include water, carbon monoxide and/or other fluids. The subterranean zone can include all or a portion of a resource bearing subterranean formation, multiple resource bearing subterranean formations, or all or part of one or more other intervals that it is desired to treat with the heated fluid. The fluid is heated, at least in part, using heat from decomposing a reactant, for example hydrogen peroxide.

Figure 1:
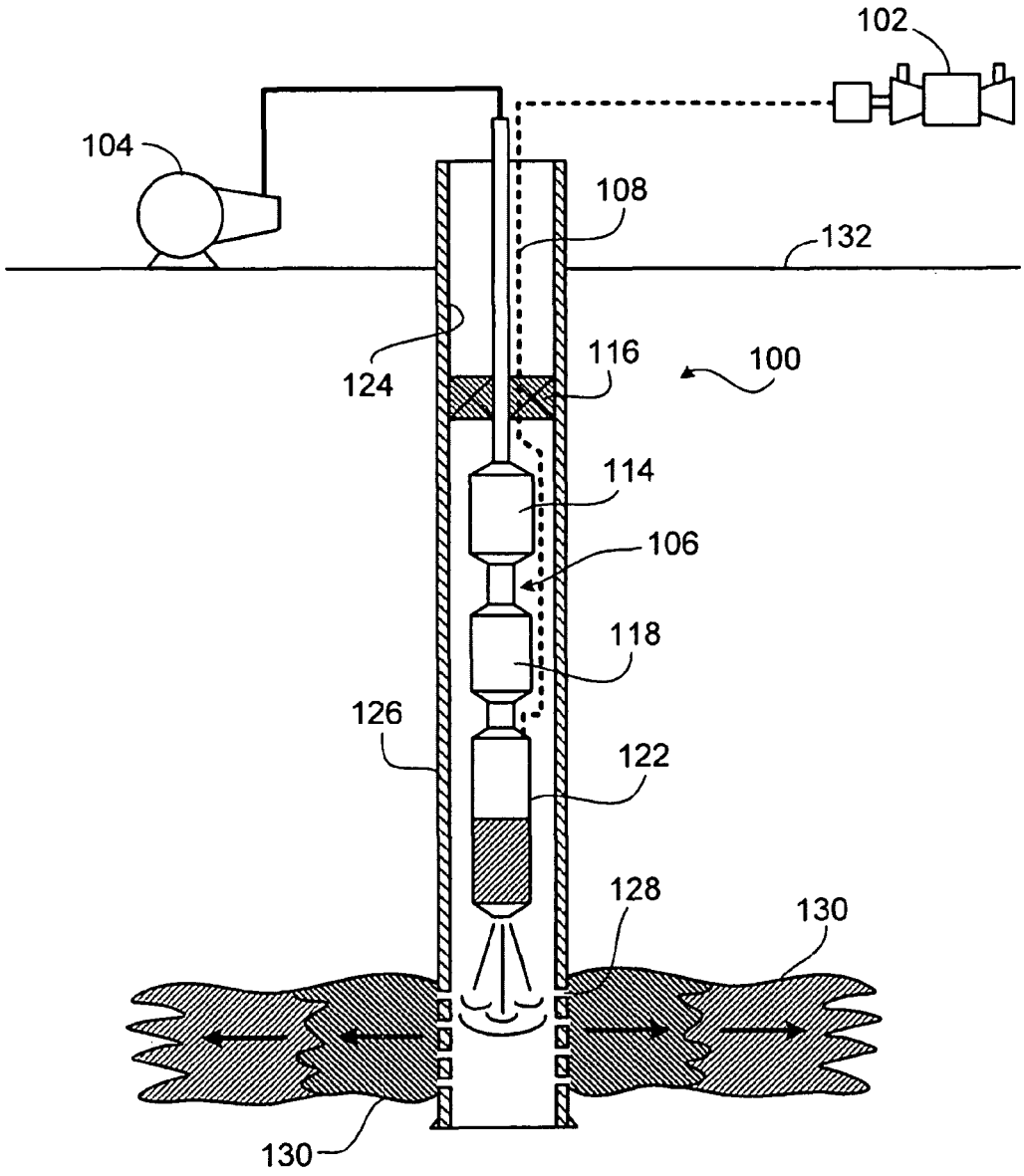
FIG. 1 is a schematic of an embodiment of a down hole steam generation system.

Turning now to FIG. 1, one example of a downhole heated fluid generation system 100 is schematically depicted. The system 100 includes a working string 106 adapted for insertion into a well bore 126. The well bore 126 extends through a subterranean zone 130, and in other instances, may extend through one or more additional subterranean zones. In the present example, the subterranean zone 130 is the zone that will be treated with heated fluid from the system 100. Although, well bore 126 is depicted substantially vertical, in other instances, the well bore can deviate from vertical and may include curved, slanted, and/or horizontal portions. Also, in certain instances, one or more additional well bores may be provided. For example, in SAGD, the heated fluid may be injected through one well bore and resources may be produced through one or more different well bores. It is common for SAGD to use two or more substantially parallel, horizontal well bores extending through the subterranean zone, wherein at least one of the well bores is used for heated fluid injection and at least one of the well bores is used to recover resources from the subterranean zone.

A casing 124 extends through the well bore 126 and into the subterranean zone 130, and includes apertures (e.g., perforations 128) in or near the zone 130. In other instances, the well bore 126 can include an open hole portion (i.e. having no casing), for example, in or near the zone 130.

A number of different tools are provided in the working string 106 for the heated fluid treatment process, including a packer 116, a downhole reactor 114, a liquid/gas separator 118, and a combustor 122. In other instances, fewer or additional tools may be provided.

Packer 116 is actuable to seal or substantially seal against the wall of well bore 126 (e.g., casing 124) and hydraulically isolate a portion of the well bore 126 from the remainder of the well bore 126. The packer 116 can be actuated mechanically, e.g., through manipulation of the working string 106, hydraulically, electrically or in any other manner. FIG. 1 depicts the packer 116 positioned to isolate the portion of the well bore 126 through the subterranean zone 130 from the remainder of the well bore 126. In other instances, additional packers may be provided. For example, multiple, spaced packers may be provided to isolate intervals between the packers, and may be used to isolate one or more subterranean zones from one another and from the remainder of the well bore.

A pump 104 pumps a reactant or a reactant in solution downhole for use in generating the heated fluid. In certain instances, the pump 104 can reside at the surface 132. In FIG. 1, the working string 106 communicates the reactant to the downhole reactor 114. In the present example, the reactant is hydrogen peroxide and is in solution with water. Additional compounds may be provided in the solution, for example, one or more corrosion inhibitors (e.g., XTEND a registered trademark of Baker Hughes Incorporated, CRONOX FILM-PLUS a registered trademark of Baker Hughes Incorporated, and/or other corrosion inhibitors), one or more retarders to delay the decomposition reaction of the hydrogen peroxide (e.g., urea, Ph lowering or raising additives, and/or other retarders), one or more surfactant (e.g., to make the solution easier to pump or penetrate the formation), one or more anti-scaling agents, one or more solvents to hydrocarbon and/or other compounds. Although in this example the hydrogen peroxide is provided downhole in a water solution, in other instances the hydrogen peroxide (reactant) and water and/or other solution components may be provided downhole separately. The downhole reactor 114 facilitates an exothermic reaction of the reactant. In certain instances, the downhole reactor 114 is a housing that carries a catalyst selected to facilitate the exothermic reaction on contact with the reactant. The catalyst can be provided in the form of screens, plates, particulate, spheres and/or other shapes, and may be configured for favorable or maximum surface area for contacting the reactant. In certain instances, the reactor 114 can be configured without a catalyst, and catalyst can be supplied into the reactor 114 in a carrier fluid via the working string 106 or another tube that segregates the catalyst in carrier fluid from the reactant. If the reactor 114 includes a catalyst, additional catalyst can be provided by supplying the catalyst to the reactor 114 in a carrier fluid in a similar manner.

In the case of hydrogen peroxide, the catalyst is selected to cause the hydrogen peroxide to exothermically decompose into at least water and oxygen. For example, some catalysts for exothermically decomposing hydrogen peroxide include platinum, iron and/or other catalysts. Periodically, the catalyst can be cleaned or refreshed by introducing a cleaning solution into the reactor 114. In some instances, the cleaning solution can be provided down the working string 106 in lieu of the reactant or can be provided down a separate tube (not specifically shown) into the reactor 114. Some examples of cleaning solution can include an acid or a base in solution or otherwise.

The exothermic decomposition facilitated by the downhole reactor 114 or catalyst in carrier fluid heats the water and oxygen resulting from decomposition, as well as the water from solution (if the hydrogen peroxide is provided in solution). In certain instances, the exothermic decomposition may heat all or a portion of the water from decomposition and from solution to form steam of 100% quality or less.

The heated water and/or steam and the oxygen are communicated from the downhole reactor 114 to the liquid/gas separator 118. The liquid/gas separator 118 operates to separate the gaseous oxygen from the heavier water and/or steam. Liquid/gas separator 118 is a cyclone separator. In other instances, the separator can include one or more of a hydrocyclone separator, a coalescing membrane separator, or other type of separator. Two or more types of separators can be used in combination. The separated water and/or steam and the oxygen are communicated, separately to the downhole combustor 122. In certain instances, the liquid/gas separator 118 can be omitted, and for example, the oxygen and a water introduced to the combustor 122 in combined form (i.e. as oxygen rich water).

A compressor 102 at the surface 132 operates to compress a source of fuel gas. In certain instances, the fuel gas is methane, and can include methane recovered via the well bore 126 and/or methane from other sources. The compressed fuel gas is provided downhole to a downhole combustor 122. In FIG. 1, a fuel line 108 external to the working string 106 communicates the compressed fuel gas to the downhole combustor 122. In other instances, however, the fuel line 108 can be internal to, incorporated with or otherwise associated with the working string 106. Of note, although "fuel gas" is discussed herein, the fuel can take other states, including liquid, vapor, or other state.

The compressed fuel gas and oxygen (and/or oxygen rich water) are combined and combusted in the downhole combustor 122. In certain instances, the downhole combustor 122 is a catalytic combustor that includes a catalyst (in the form of screens, plates, particulate, spheres and/or other shapes) that catalyzes the oxidation (i.e. combustion) of the fuel gas and oxygen. In certain instances, the combustor 122 additionally, or alternatively, includes one or more other type of combustor. Two additional examples of combustors include a combustion chamber in which the fuel gas and oxygen are combined and ignited or a open or enclosed flame burner. The heat generated by compressing the fuel gas carried by the fuel line 108 into the downhole combustor 122, and the heat from the exothermic decomposition carried by the oxygen, together with the pressure in the combustor 122 may be enough to initiate combustion in a catalytic combustor or a combustion chamber. In some instances, additional sources of heat (not shown), such as a heated coil, spark plug, external/internal burner and/or other heater, can be provided in or near the downhole combustor 122 to initiate and/or maintain combustion of the fuel gas and oxygen. In certain instances, a source of heat can include a hypergolic fuel either positioned in the combustor 122 or introduced into the combustor 122 (e.g. pumped downhole) prior to introduction of the fuel gas. Hypergolic fuels are compounds that ignite when they come into contact with one another. To initiate combustion, the compounds can be combined downhole. A hypergolic fuel for which one component is oxygen, water, or the fuel gas can be ignited without providing additional compounds down the well bore. In certain instances, the hypergolic fuel can include triethylene borate that combusts in contact with oxygen.

The downhole combustor 122 communicates the heat from combustion of the fuel gas and oxygen to the water, for example, by contacting the heated fluid against a heated surface in the combustor 122. In certain instances, the heat from combustion may heat the water and/or water and steam mixture to higher quality steam, and in some instances 100% steam. The heated fluid is ejected from the downhole combustor 122 into the well bore 126, through the perforations 128 (if provided), and into the subterranean zone 130 to treat the subterranean zone 130.

Figure 2:
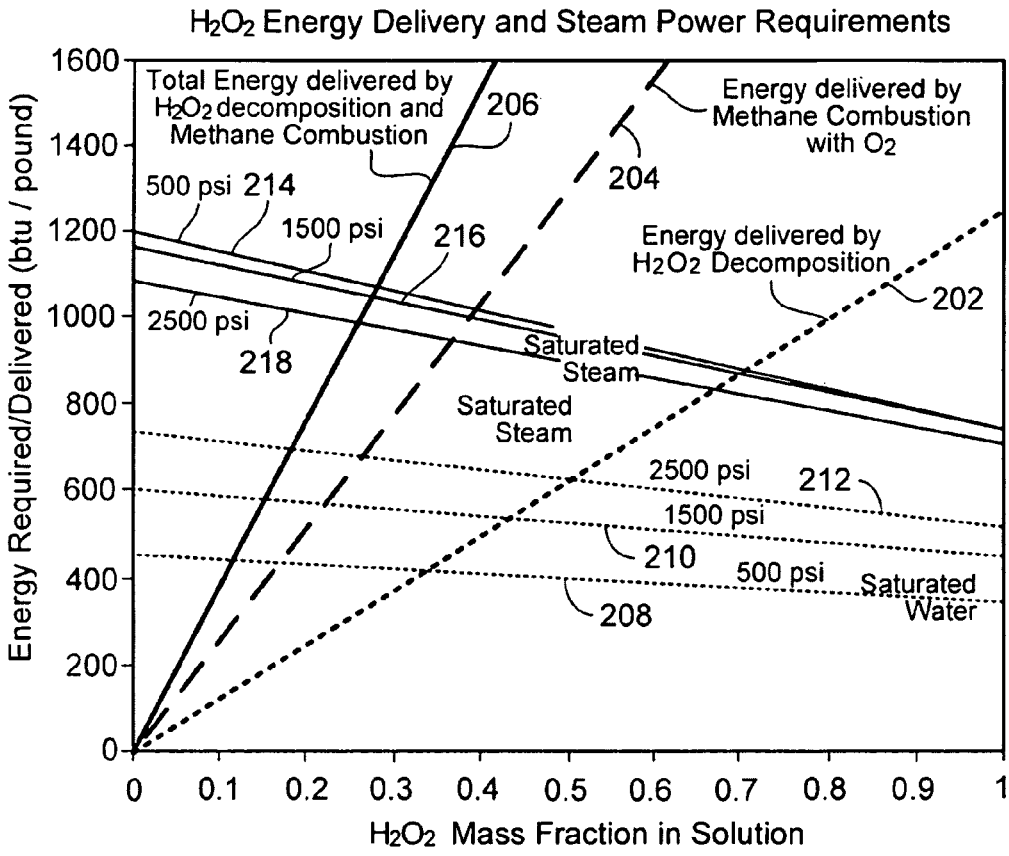
FIG. 2 is a chart of example hydrogen peroxide energy delivery and steam power requirements.

FIG. 2 shows an example of hydrogen peroxide energy delivery and steam power requirements. The Y-axis shows energy required to produce saturated water or steam and the energy delivered by various reactions (all in btu/pound). The X-axis shows hydrogen peroxide mass fraction in a solution including hydrogen peroxide and water. The heat produced during decomposition per pound of varying concentration hydrogen peroxide solution is shown by line 202. The amount of heat produced by burning methane gas with the oxygen produced by complete decomposition is shown by line 204, and the total heat produced during decomposition and subsequent methane combustion is shown by line 206. These lines are superimposed over lines showing the amount of heat required to produce saturated water and steam at various pressures: line 208 shows saturated water at 500 psi; line 210 shows saturated water at 1500 psi; line 212 shows saturated water at 2500 psi; line 214 shows saturated steam at 500 psi; line 216 shows saturated steam at 1500 psi; and line 218 shows saturated steam at 2500 psi. Thus, by way of example, to produce 100% quality steam at 1500 psi using both heat from decomposition of the hydrogen peroxide and the heat from combusting oxygen from decomposition, a solution of approximately 27% by mass of hydrogen peroxide is needed—depicted by where line 206 and line 216 cross. Since FIG. 2 assumes 100% efficiency of decomposition and combustion, some additional amount of hydrogen peroxide may be used to ensure 100% steam quality is achieved. The additional amount of hydrogen peroxide in solution may be determined experimentally, and/or may be determined from a chart similar to FIG. 2 that accounts for inefficiencies derived from further experiments with specific embodiments of the reactor and combustor.

Of note, by combusting the oxygen from decomposition of hydrogen peroxide, less hydrogen peroxide is needed to heat a given amount of water to a specified state (e.g. saturated steam) than if the heat of decomposition were relied on alone. In other words, lower concentrations of hydrogen peroxide can be used to treat a subterranean zone. Lower concentration hydrogen peroxide solutions are safer and easier to produce at the well site than higher concentration solutions. Further, as compared to conventional downhole fluid heating by combustion alone, compression costs of compressing air or oxygen for the combustion are eliminated, because the hydrogen peroxide provides oxygen.

A number of embodiments have been described. Nevertheless, it will be understood that various modifications may be made. Accordingly, other embodiments are within the scope of the following claims.

What is claimed is:

1. A method for treating a subterranean zone, comprising:
exothermically decomposing hydrogen peroxide downhole in or near the subterranean zone to yield at least oxygen and heated water;
receiving a hydrocarbon fuel, communicated from a location remote to the subterranean zone, at a location downhole in or near the subterranean zone;
combusting the oxygen and the hydrocarbon fuel downhole in or near the subterranean zone to further heat the heated water; and
treating the subterranean zone with the heated water.

2. The method of claim 1, wherein the hydrogen peroxide is in a solution comprising water and wherein combusting the oxygen to further heat the heated water comprises combusting the oxygen to further heat both the water from decomposing hydrogen peroxide and the water from solution.

3. The method of claim 2, wherein the solution comprises at least 27% hydrogen peroxide by mass.

4. The method of claim 2, wherein the solution comprises more water than hydrogen peroxide.

5. The method of claim 1, wherein the oxygen is combusted in a downhole catalytic combustor.

6. The method of claim 1, wherein exothermically decomposing the hydrogen peroxide comprises exothermically decomposing the hydrogen peroxide in a downhole reactor comprising a catalyst.

7. The method of claim 1, wherein the hydrocarbon fuel is methane gas.

8. The method of claim 1, wherein the heated water comprises 100% quality steam.

9. The method of claim 1, further comprising pumping the hydrogen peroxide into the subterranean zone.

10. The method of claim 1, wherein the location remote to the subterranean zone comprises a surface location.

11. The method of claim 1, further comprising:
ejecting the heated water into a well bore in or near the subterranean zone; and
producing a fluid from the subterranean zone through the well bore.

12. The method of claim 1, further comprising separating the heated water from the oxygen.

13. A system for treating a subterranean zone, comprising:
a downhole reactor having a catalyst for decomposing hydrogen peroxide into at least heated water and oxygen;
a downhole separator configured to separate the heated water from the oxygen; and
a downhole combustor in communication with the downhole reactor and configured to receive the heated water and oxygen and receive a hydrocarbon fuel communicated to the combustor through a fuel conduit coupled to the combustor, combust the oxygen and the hydrocarbon fuel to further heat the heated water and output the heated water to the subterranean zone.

14. The system of claim 13, wherein the separator comprises a hydro-cyclone separator.

15. The system of claim 13, wherein the combustor is a catalytic combustor.

16. The system of claim 13, further comprising a conduit supplying a solution comprising water and hydrogen peroxide to the downhole reactor.

17. The system of claim 16, wherein the solution comprises at least 27% hydrogen peroxide by mass.

18. The system of claim 13, wherein the downhole combustor is configured to heat the water to make 100% quality steam.

19. The system of claim 13, wherein the hydrocarbon fuel is methane gas.

20. A method, comprising:
receiving hydrogen peroxide and hydrocarbon fuel from a location at the surface into a well bore;
contacting the hydrogen peroxide with a catalyst to decompose it into at least heated water and oxygen;
separating the heated water and the oxygen in the well bore; and
combusting the oxygen and the hydrocarbon fuel to further heat the heated water.

21. The method of claim 20, wherein supplying hydrogen peroxide comprises supplying hydrogen peroxide in solution with water.

22. The method of claim 20, wherein the water is heated to 100% quality steam.

23. The method of claim 20, further comprising:

compressing the hydrocarbon fuel; and initiating the combustion of the oxygen and the hydrocarbon fuel with heat energy from compressing the hydrocarbon fuel and heat energy from the heated water.

* * * * *